US006748826B2

(12) United States Patent
Marks

(10) Patent No.: US 6,748,826 B2
(45) Date of Patent: Jun. 15, 2004

(54) SLIDE SWITCH ADJUSTABLE WRENCH

(75) Inventor: Joel Marks, Sherman Oaks, CA (US)

(73) Assignee: Work Tools, Inc., Chatsworth, CA (US)

( * ) Notice: Subject to any disclaimer, the term of this patent is extended or adjusted under 35 U.S.C. 154(b) by 0 days.

(21) Appl. No.: 10/078,518

(22) Filed: Feb. 21, 2002

(65) Prior Publication Data

US 2002/0112574 A1 Aug. 22, 2002

Related U.S. Application Data

(60) Provisional application No. 60/270,181, filed on Feb. 22, 2001.

(51) Int. Cl.[7] ..... B25B 13/16

(52) U.S. Cl. ..... 81/165; 81/166; 81/167; 81/168; 81/169; 81/170

(58) Field of Search ..... 81/37, 129, 165, 81/172, 341, 63.2, 61, 62, 133, 142, 144, 167, 166, 168, 169, 170, 171

(56) References Cited

U.S. PATENT DOCUMENTS

| | | | | | |
|---|---|---|---|---|---|
| 1,245,581 | A | * | 11/1917 | Gniewcrynski | 81/134 |
| 2,514,130 | A | | 7/1950 | Jones | 81/37 |
| 3,368,432 | A | * | 2/1968 | Halls | 81/165 |
| 3,555,939 | A | * | 1/1971 | Halls | 81/165 |
| 3,640,159 | A | * | 2/1972 | Halls et al. | 81/165 |
| 3,673,896 | A | * | 7/1972 | Vardaman | 81/165 |
| 3,901,107 | A | | 8/1975 | Halls | 81/129 |
| 4,028,970 | A | * | 6/1977 | Pelczar | 81/165 |
| 4,046,034 | A | | 9/1977 | Flewelling | 81/165 |
| 4,106,372 | A | * | 8/1978 | Miller | 81/143 |
| 4,802,390 | A | | 2/1989 | Warheit | 81/341 |
| 5,557,993 | A | * | 9/1996 | Austin | 81/165 |
| 6,076,434 | A | * | 6/2000 | Boukis | 81/165 |

* cited by examiner

*Primary Examiner*—Lee D. Wilson
*Assistant Examiner*—Alvin J. Grant
(74) *Attorney, Agent, or Firm*—Brad I Golstein

(57) ABSTRACT

A slide switch adjustable wrench uses a laminated steel construction method that includes a stepped surface to form a guide for the worm gear driven moving jaw. A molded or similarly formed body is sandwiched between the steel housing sides to form a sturdy structure. The body provides cavities, bearings and other features to support and guide moving parts within. A rack and pinion drive system uses simple molded gears to amplify about 2 inches of switch travel into about 6 turns of the worm gear. An overmolded rubber edge grip bonds to the body to create a recess in the body; this recess seamlessly fits the steel sides to form a smooth continuously contoured grip surface.

20 Claims, 6 Drawing Sheets

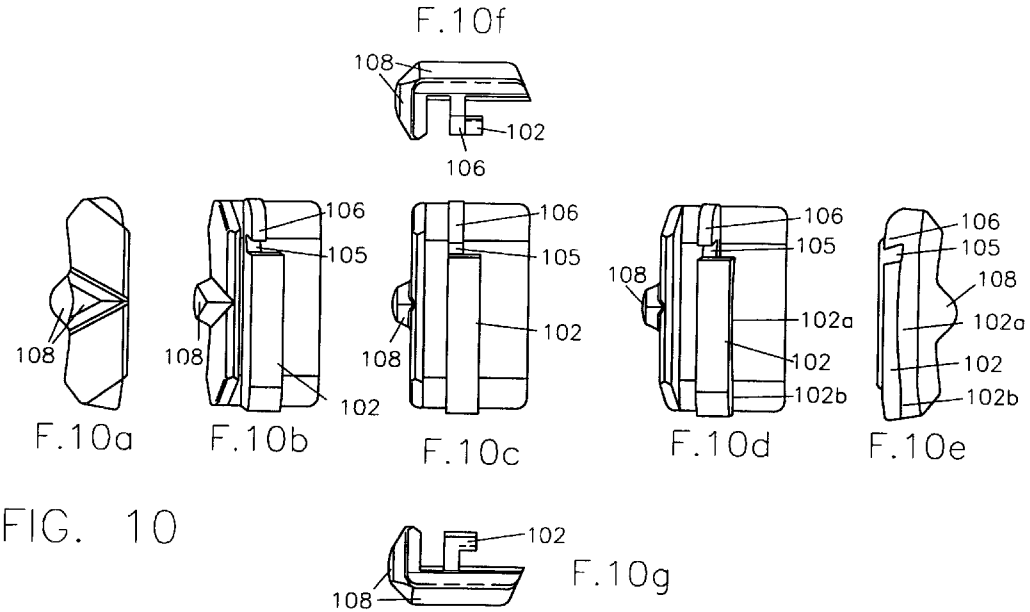
FIG. 10
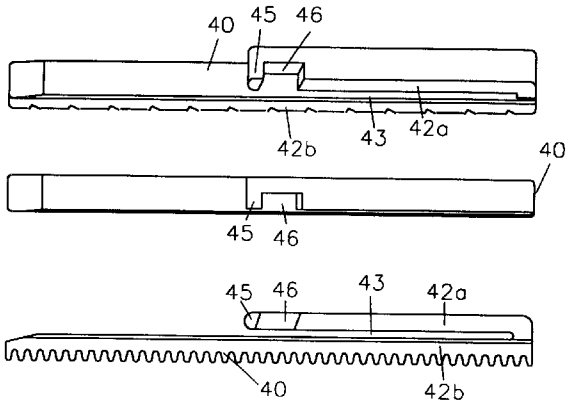
FIG. 11a
FIG. 11b
FIG. 11c

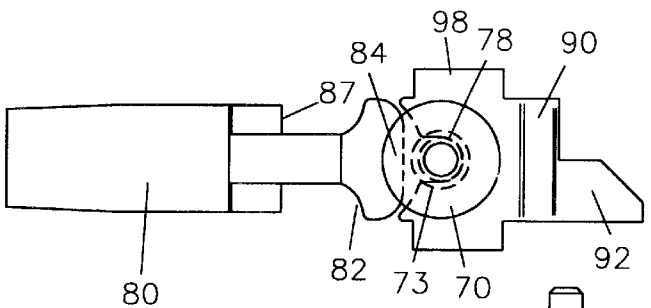
FIG. 12
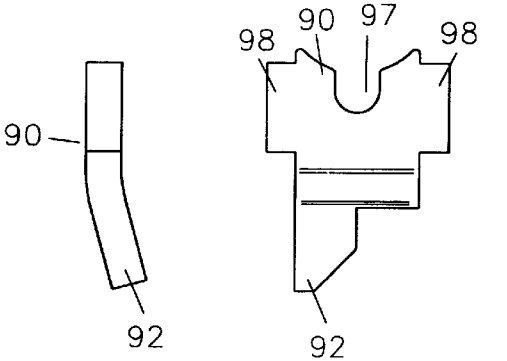
FIG. 13a
FIG. 13b
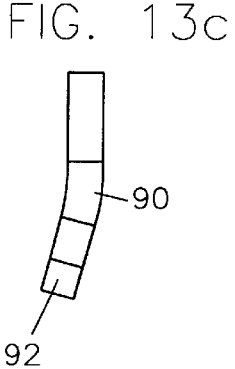
FIG. 13c
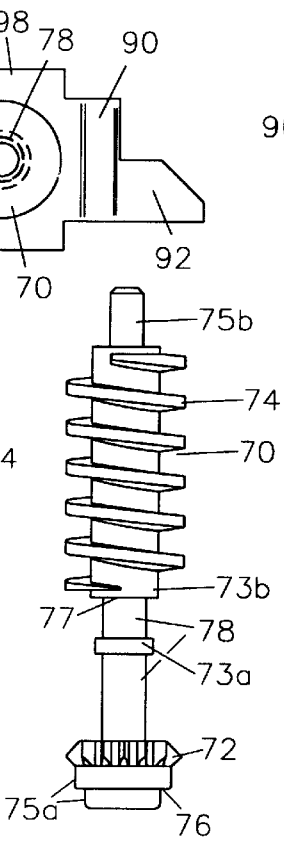
FIG. 15
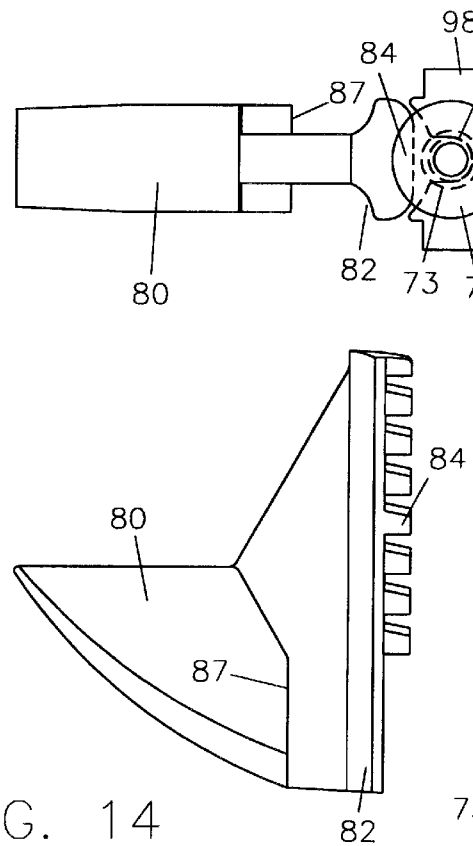
FIG. 14
FIG. 16a
FIG. 16b

SLIDE SWITCH ADJUSTABLE WRENCH

This application claims the benefit of Provisional application Ser. No. 60/270,181, filed Feb. 22, 2001.

FIELD OF THE INVENTION

The present invention relates to adjustable wrenches. More precisely the present invention relates to a slide switch controlled movable jaw open wrench.

BACKGROUND OF THE INVENTION

Adjustable jaw wrenches are well known. A movable jaw slides in a guide track, opposed to a fixed jaw, the jaws comprising an engaging end of the wrench. The guide track is cut in a solid formed housing, while the jaw is adjusted by means of a worm gear that is supported within the housing. Typically the worm gear functions as a thumb wheel wherein rotating the worm gear causes the jaw to move toward and away from the fixed jaw. An improvement to these devices has been to link the worm gear to a slide switch so that moving the switch causes the gear to rotate and the jaw to move.

Two methods to link a sliding switch to a worm gear are typical of the prior art. According to one version, a sliding element links to a helical shaft so that moving the sliding element along the shaft causes the shaft to rotate. A front end of the shaft has a bevel gear or equivalent gear which mates to a respective gear affixed to a common shaft of the worm gear. Thus moving the sliding element causes the worm gear to rotate and the movable jaw to adjust. U.S. Pat. Nos. 3,640,159 and 4,046,034 are examples of a helical shaft type slide adjustable wrench.

Another type of slide adjustable wrench uses a belt or chain around pulleys to link a sliding element to the worm gear. U.S. Pat. Nos. 3,368,432 and 3,901,107 provide examples of this method. In '432 the belt is directly linked to the worm gear shaft. In '107 the belt turns an intermediate shaft with a beveled gear linking to the worm gear shaft.

A problem in designing a slide adjustable wrench is to provide an adequate amount of jaw travel within a reasonable range of motion of sliding. The sliding should be a comfortable motion for a user's finger, not much over about 2 inches if the operating hand is not to be repositioned. Some type of reducing drive system (or more accurately an increasing system) is needed to achieve a useful slide motion relative to jaw motion. One option is to use a steep angle for the cut of the worm gear. However if this angle exceeds by much that used in conventional adjustable wrenches, the jaw will not reliably hold a position under force. Rather the jaw will cause the worm gear to rotate in the manner of a helical driven shaft. A typical effective worm gear using a suitable cut angle needs about 5 to 6 turns to give a full jaw travel. A further option is to employ a reduction at the bevel gear where a shaft meets the worm gear shaft. For example in the helical shaft design of '034 bevel gear 42 on axle 40 can be smaller than bevel gear 56 on helical shaft 50. At increasing reductions however gear 42 will become impractically small or gear 56 very large. A larger gear 56 will require excess enlargement of the surrounding casing. A related issue is the angle of helical groove 52 in drive shaft 50. A steeper, or more perpendicular, angle of the groove will cause the shaft to rotate faster in relation to the sliding motion of button 54. However the practical steepness is limited by friction to about 30° off-axis.

A further problem with a helical shaft design is that such a shaft is not easily produced by simple molding or die casting methods. Such a mold would need multiple elements to avoid under cuts. Thus a good helical shaft is not easily made with low cost.

A belt design must also include some reducing method. For example in '107 the size of pulley 56 must be minimized. However practical belts limit this diameter to not less than about ¼ inch, below which strength is greatly compromised. Bevel gear 58 must also be larger than gear 28 as for '034 above. It so happens that neither reference shows such gears. Empirical testing has shown that these respective designs will not provide adequate jaw motion. A further problem with a belt design is difficulty handling the non-rigid belt during assembly. The design of '107 provides a complex preassembly fixture as a part of the tool to facilitate handling the belt.

Typical of the prior art is a solid forged housing. It is a well known method to guide and support the movable jaw. Such a housing is reasonable for a conventional adjustable wrench where few components are fitted within. However a slide adjustable wrench requires a large cavity to fit the functional components. Such a cavity requires complex forging or slow cutting operations to form. Another method to form a wrench body is disclosed in U.S. Pat. No. 4,802,390. In this reference laminated plier handles include two sheet metal plates surrounding respective plastic spacers. The spacers hold the metal plates in a spaced and parallel relationship, but do not contain or guide functional components. A plastic sleeve surrounds at least one handle to prevent a user pressing sharp metal edges. U.S. Pat. No. 1,061,046 shows an adjustable wrench with a tubular body formed of a thin non-specific material. The jaw slides in a telescoping arrangement in the body. U.S. Pat. No. 2,514,130 shows a locking plier with a body formed of convoluted sheet metal elements.

There is an opportunity to improve upon the prior art designs in both cost and function.

SUMMARY OF THE INVENTION

In the present invention an improved all-gear drive system for a slide adjustable wrench is disclosed. A rack and pinion gear set converts linear motion of a slide switch to rotational motion of a gear shaft. A further drive shaft translates the rotational motion to a worm gear shaft. A laminated steel housing contains a molded or cast body which in turn contains the gears and other components. The gears are discrete rigid elements that are easily handled during assembly and readily held in repeatable positions in use. The gears may be produced by low cost molding, powder metal, or die casting methods. A gear rack is slidably fitted in a channel of the body and linked to the slide switch. A pinion rotates about a fixed axis within the housing. and mates to the gear rack. A bevel gear is fixed to the pinion below the pinion with the combined assembly forming a pinion gear shaft. The bevel gear is preferably larger in diameter than the pinion with the resulting gear ratio increasing the rotation speed of further driven gears. A drive shaft includes two bevel gears at each end with one end mated to the bevel gear of the pinion gear shaft. The bevel gear at the other end mates with a final bevel gear on a worm gear shaft. The worm gear adjusts and holds a movable jaw in a conventional way. Although numerous gears are involved in operating the wrench of present invention, there are only four geared parts, all of which are conventionally and easily made and assembled. These parts are: the rack, the pinion shaft, the drive shaft, and the worm gear.

The present design is especially practical when the gears are guided and supported by a molded body that is held between metal plates or within a simple cavity of a forged housing. The body includes recesses, ribs, slots and other features to reliably hold the parts in position. This mechanical function of the body is in addition to a spacer function. The multifunction body eliminates the need for expensive forging or cutting of cavities in a solid metal housing.

According to a preferred embodiment of the invention the slide switch includes a top facing element. Then the switch may be accessed by either hand from most any position. Optionally the switch also includes a portion facing at least one side to ease its use from certain positions. The slide switch may link to the internal elements through a narrow top facing slot in the wrench handle.

The wrench handle optionally includes a rubber edge to cover the metal edges. This edge is overmolded onto the plastic body to form a prefabricated composite of the relatively rigid plastic body and the soft rubber edge. The rubber forms a raised edge forming ribs around the body to provide a recess into which fits the thickness of the metal plates. According to the invention the rubber edge is closely fitted to and covers the metal edges while being secured by the plastic body. Optionally the edge may be of the same material as the body but still be raised to form a recess for the metal plates forming a smooth continues transition between the metal sides and the plastic edge.

BRIEF DESCRIPTION OF THE DRAWINGS

FIGS. 10*a* to 10*g* are views of a switch

FIG. 10*a* is a side elevation of the switch.

FIG. 10*b* is bottom-side isometric view of the switch.

FIG. 10*c* is a bottom view of the switch.

FIG. 10*d* is a bottom side isometric view of the switch, from the opposite side of FIG. 10*b*.

FIG. 10*e* is a side elevation of the switch, from the opposite side of FIG. 10*a*.

FIG. 10*f* is a rear end elevation of the switch.

FIG. 10*g* is a front end elevation of the switch.

FIGS. 11*a* to 11*c* are views of a gear rack.

FIG. 11*a* is a top-side isometric view of the gear rack.

FIG. 11*b* is a top view of the gear rack.

FIG. 11*c* is a side elevation of the gear rack.

FIG. 12 is a top view of an assembly of a jaw, worm gear, and worm gear retainer.

FIGS. 13*a* to 13*c* are views of a worm gear bracket.

FIG. 13*a* is a side elevation of the bracket.

FIG. 13*b* is a top view of the bracket.

FIG. 13*c* is a side elevation of the bracket, from the opposite side of FIG. 13*a*.

FIG. 14 is a side elevation of a movable jaw.

FIG. 15 is a side elevation of a worm gear shaft.

FIG. 16*a* is a front elevation of a fixed jaw insert.

FIG. 16*b* is a side elevation of the jaw insert of FIG. 16*a*.

DETAILED DESCRIPTION OF THE INVENTION

Figure 1:
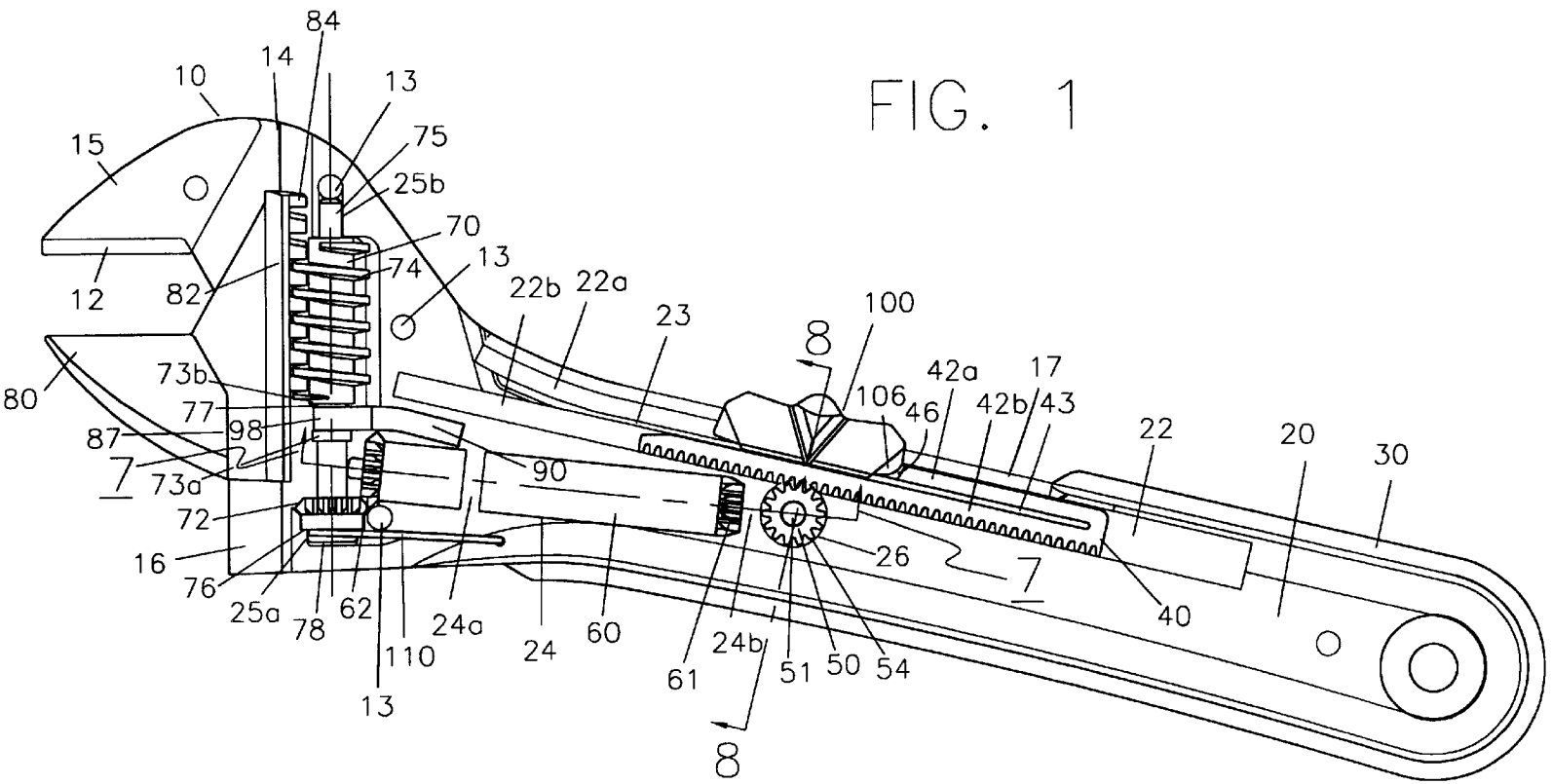
FIG. 1 is a side elevation of a slide wrench of the invention, with the switch and jaw in an intermediate position, viewed with the facing housing side removed.
Figure 2:
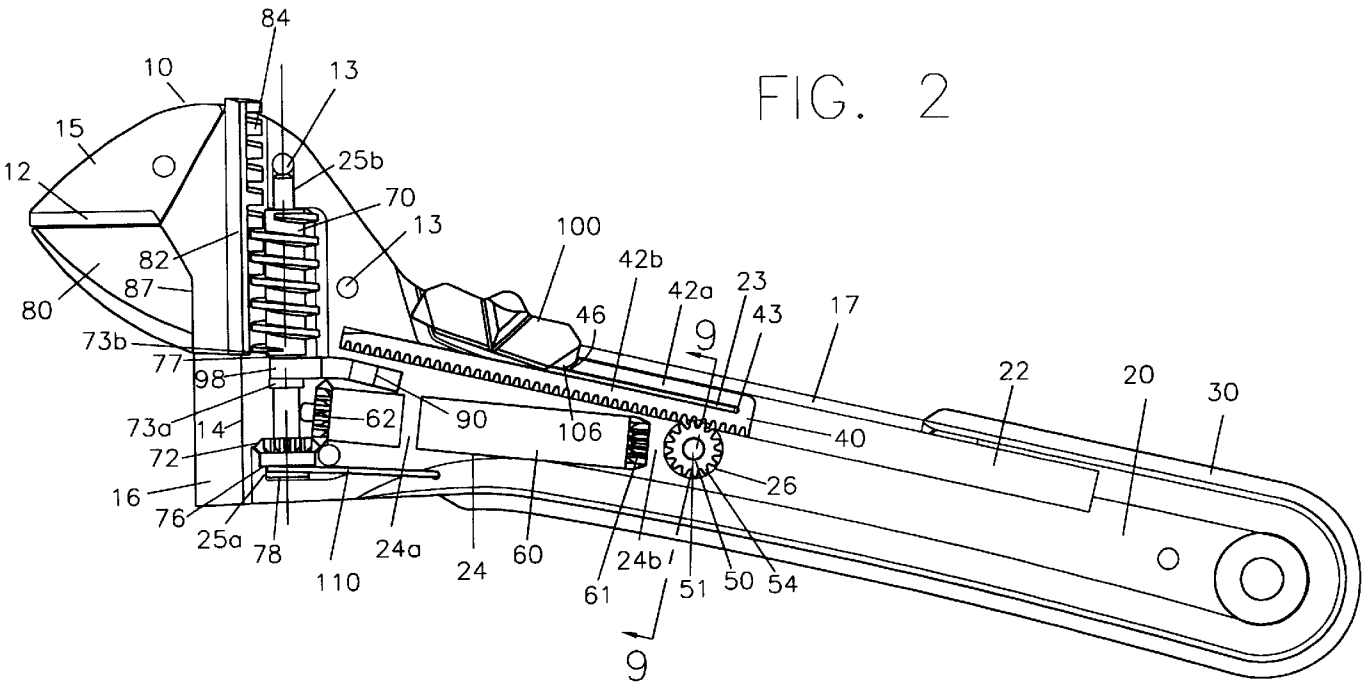
FIG. 2 is the wrench of FIG. 1 with the switch in a forward-most position and the jaw fully closed.
Figure 9:
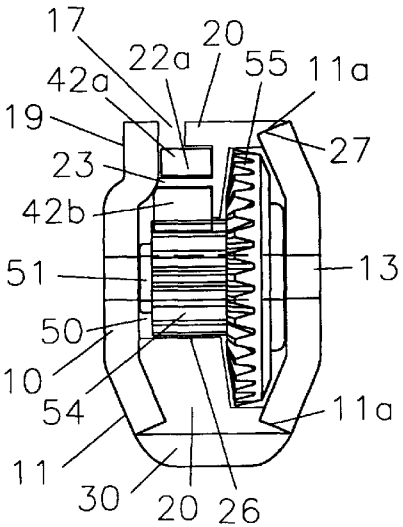
FIG. 9 is the sectional view of FIG. 8 except it corresponds to the switch position of FIG. 2.
Figure 8:
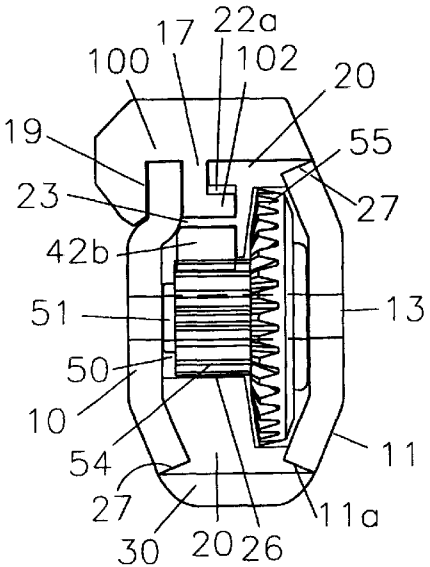
FIG. 8 is a transverse partially sectional view of the wrench of FIG. 1 showing a pinion gear shaft, rack, and switch.

In a preferred embodiment of the present invention a series of rigid gears links a slide switch to a jaw holding worm gear. In FIG. 1 most of the essential elements of the wrench are visible. However FIGS. 8 and 9 show bevel gear portion 55 of pinion gear shaft 50. Moving slide switch about two inches 100 causes jaw 80 to move fully toward and away from the flange comprising fixed jaw face 12 of upper jaw insert 15 (FIG. 16). The flange may extend to cover the down facing metal edges of housing 10. Jaw insert 15 may be forged, machined or of powdered metal. In FIG. 1 switch 100 and jaw 80 are in an intermediate position. In FIG. 2 switch 100 has been pushed forward causing jaw 80 to close against face 12. Rack 40 is pivotably linked to switch 100 so that as switch 100 is moved, rack 40 moves with it. Switch 100 connects to rack 40 through notch 105 and tab 106 of the switch (FIG. 10). Specifically tab 106 extends into notch 46 (FIGS. 1,2, 11). Tab 45 forms the front limit of notch 46 in rack 40. Rack 40 includes an upper link arm 42*a* and a lower gear arm 42*b*. These arms are separated by gap 43. Rib 23 of body 20 (FIGS. 5,6) slidably fits in gap 43. Accordingly link arm 42*a* fits channel 22*a* of body 20 and gear arm 42*b* fits channel 22*b*. These features are also seen in FIG. 9. Rack 40 is exposed to the exterior of the wrench by way of slot 17 (FIG. 9).

It is desirable to limit the exposure of the internal parts to the outside. In particular pinion gear 50 should be protected from direct outside exposure to prevent dirt contamination. Therefore link arm 42*a* makes an indirect path to gear arm 42*b* with rib 23 forming a divider. A multi-layered barrier between pinion gear 50 and the exterior environment reduces the opportunity for dirt to enter the mechanism near the pinion shaft. In FIGS. 8 and 9 it can be seen that rib 23 forms a good seal against housing 10. Further back in the wrench rib 23 is absent (FIG. 5) to fit the limited length of gap 43. In this area the space between gear arm 42*b* and housing 10 comprises the dirt seal (FIG. 9). But the rear area is inherently a less direct exposure to pinion shaft 50. Switch 100 may optionally be directly connected to gear arm 42*b*, pivotably or not, without the use of link arm 42*a* or rib 23.

It can be seen in FIG. 2 that switch 100 has rotated slightly relative to rack 40. Channel 22*a* is respectively curved near its front, FIGS. 5 and 6. This curve allows switch 100 to move forward as much as possible while allowing for a pleasing contour to the wrench shape where the head and handle portion meet. The head is the wide portion to the left in FIG. 1; the handle is the elongated extension to the right of the head. The rotation of the switch also provides a tactile feedback that jaw 80 is near its most closed position. Since switch 100 links to rack 40 at substantially a single point, notch 46 and tab 106, the switch can pivot slightly about this point. Channel 22*a* and the corresponding shape of the wrench handle may be entirely straight as a further option, or the switch not travel as far forward, so that switch 100 does not need to rotate. Switch 100 is held to the wrench by engagement of rib 102 of the switch within channel 22*a* of body 20, FIG. 8. Slot 17 combined with channel 22*a* form an "L" shaped slot into which fits "L" shaped rib 102. When the steel plates comprising housing 10 and body 20 are assembled, switch 100 is slidably held in place. Comparing FIGS. 8 and 9 it can be seen that either of rib 102 or link arm 42*a* may occupy channel 22*a* depending on the switch position; or put another way, both rib 102 and arm 42*a* may occupy channel 22*a*. Switch 100 is in front of link arm 42*a* except where tab 106 and notch 46 interact. In the area of notch 105 parts of each of the switch and link arm 42*a* occupy proximate portions of channel 22*a*. Rib 102 includes curved face 102*a* and flat face 102*b*. These shapes provide for a good fit of rib 102 within channel 22*a* for the possible rotational positions of switch 100 relative to rack 40. Switch 100 includes a top and a side portion (FIG. 10*f*) so that the switch may be operated from either atop the wrench or from a side. The switch provides for side operation only from the facing side in FIGS. 1 and 2. It had been found that a two sided switch may cause interference with a user's hand. The tool should not have movable obstructions facing the palm of a hand. While the switch is primarily worked from the top, the illustrated design suggests a bias toward right handed use when operated from the side. Of course the switch may be designed to protrude in one or all of upward and to the sides if it is preferred. Further it may attach to the bottom of the wrench if the gears and other elements are positioned to provide for a bottom mounted switch with for example a slot 17 facing downward. Bump 108 extends in the selected directions to facilitate moving switch 100. According to one alternative the switch may be only side mounted in a manner similar to the prior art designs. A slot cut in the side face of housing 10 would allow linking the switch to gear arm 42*b*.

Figure 4:
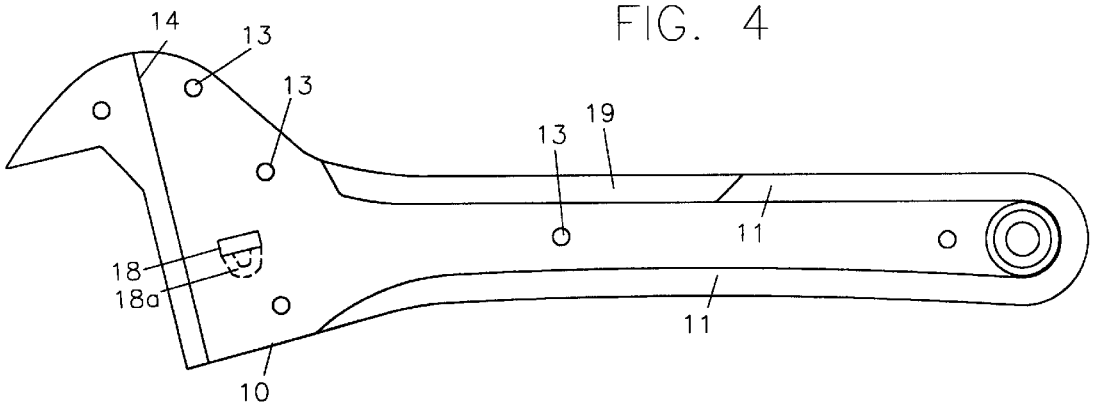
FIG. 4 is the housing side that normally covers the wrench of FIG. 1, in the view of FIG. 1.
Figure 5:
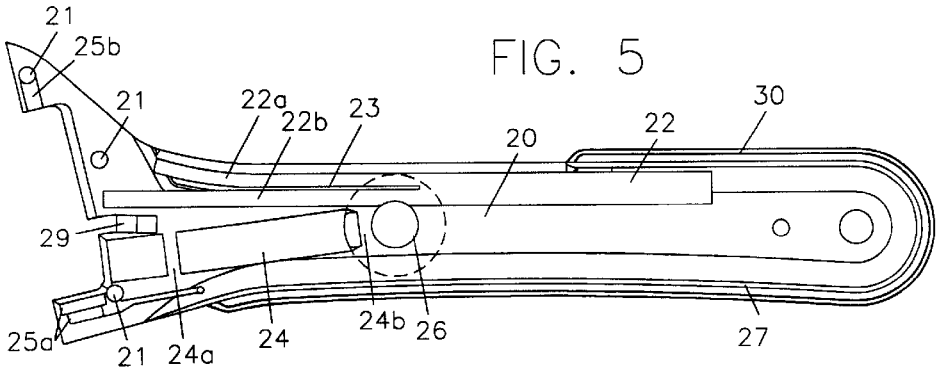
FIG. 5 is a side elevation of a molded wrench body.
Figure 6:
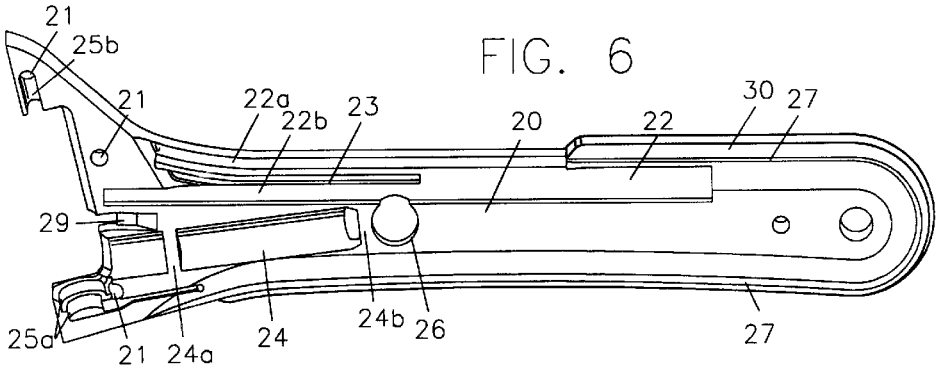
FIG. 6 is an isometric side and slightly top view of the body of FIG. 5.

In the illustrated embodiment housing 10 includes contours on its face(FIGS. 4, 8, 9). Bevel 11 improves the comfort of the grip. Channel 19 fits the side extension of switch 100.(FIG. 8). Along with bevel 11 in housing 10, body 20 preferably includes rubber overmold 30. As seen in FIG. 8 rubber 30 provides a smooth continuous connection to bevel 11. Other particular shapes may be used for contours in housing 10 and rubber 30 such as bend angles, radii etc. Although rubber 30 is most practically fixed to plastic body 20, the rubber externally appears well fitted to the edges of housing 10. If suitable resins are used for body 20 and rubber 30, they can be bonded together chemically during overmolding. Body 20 may be made from die cast or powdered metal or other chemically dissimilar materials in which case the rubber can be secured to the body by molding the rubber around ribs formed into edges of body 20 or other mechanical fastening means. With bevel 11 the edges of housing 10 are angled at 11*a* as shown in FIG. 9. Material from body 20 extends as a wedged rib, as viewed in a transverse cross section, into the space formed between rubber 30 and housing 10 at these edges. Face 27 of housing 20 defines one side of this wedge, and closely mates with edge 11*a* of bevel 11. The bond between rubber 30 and body 20 therefore extends very closely to the exterior of the housing. The exterior angled contour between bevel 11 and rubber 30 is largely continuous and unbroken. If it is preferred the material of body 20 may be used in place of rubber 30. For example if body 20 is made from metal, such as powder metal or die cast, an all metallic appearance to the wrench can be had. In this case the wedged rib described above would remain, but with a wider base since it would include the dimension of the material that was part of rubber 30. By covering the edges of housing 10 as in FIG. 9, or FIG. 8, the material of body 20 provides a smooth angled edge just as with rubber 30. In effect body 20 includes a flange to surround the edges of housing 10 and create a recess for housing 10. In FIGS. 5 and 6 this recess has a perimeter defined by face 27. This design provides an advantage over the prior art steel plate laminated handles where a vinyl dipped or other sleeve type cover is used to hide the metal edges. For example plastic sleeve 34 in U.S. Pat. No. 4,802,390 is used to entirely cover the handle. By providing a recess in body 20 of the present invention to fit the plates of housing 10, the steel edges are hidden in a low cost pleasant looking design.

Housing 10 includes through holes 13 to fit rivets, not shown, that hold the assembly together. Body 20 has corresponding holes 21. Exemplary holes are noted in FIGS. 4 and 5. In the case of pinion shaft 50, a hole 51 may be provided through the shaft instead of a body hole 21 (FIGS. 8, 9). A rivet shank may then serve as a rotation axle for pinion shaft 50.

Figure 7:
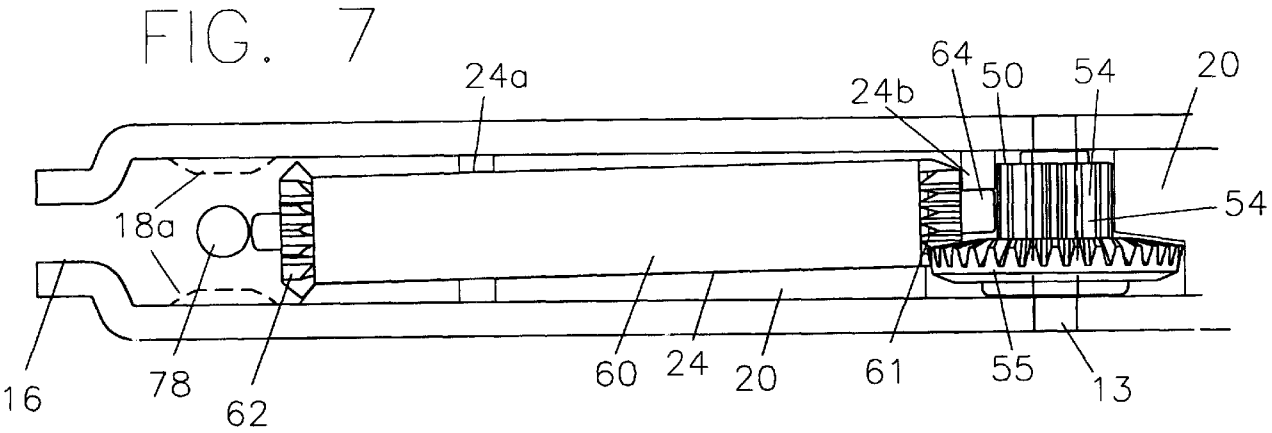
FIG. 7 is a longitudinal partially sectional view of the wrench of FIG. 1 showing a pinion gear shaft, drive shaft, and worm gear stem.

Pinion shaft 50 includes two main elements, pinion gear 54 which is normally a straight cut spur gear, and the larger diameter bevel gear 55. If desired an intermediate pinion spur gear may link gear arm 42*b* to gear 54 so that gear 54 indirectly engages gear arm 42*b*. Further intermediate gears may also be used along the drive system if desired. Cavity 26 in body 20 surrounds gear 54. The relative diameters of gears 54 and 55 and bevel gear 61 determines the speed ratio between pinion gear 54 and drive shaft 60. In addition the absolute diameter of pinion gear 54 determines the relationship of rotation speed of pinion shaft 50 to the travel distance of rack 40. A smaller diameter pinion provides more turns per distance traveled of rack 40. However as seen in FIGS. 1 and 2 if pinion gear 54 is too small, bevel gear 61 will interfere with gear arm 42*b* since the gear arm would move down to meet a smaller pinion gear 54. The intermediate pinion gear described above could help distance pinion shaft from bevel gear 61 to prevent this interference at the possible expense of an additional part. A smaller gear 61 could also provide more speed increase. However, as seen in FIG. 7, this gear is in fact as large as possible within the thickness of the housing while even still remaining small. If too small the gear would become weak since few teeth would provide engagement to bevel gear 55. To provide a large speed increase bevel gear 55 is large in diameter relative to gears 54 and 61. As seen in FIGS. 7, 8, and 9 gear 55 is oriented flat in the housing so that it can be large in relation to gear 61 while still fitting within the thickness and width of the housing. It is a feature of the invention that pinion shaft 50 includes two gears as elements of a single piece that can be made by molding or die casting. Gears 55, 61, 62 and 72 are shown in the form of bevel gears. Bevel gears are typically used for engagements near 90°. However other types of gears such as hypoid, spur, low ratio worm, and others may be substituted if desired as long as the type of angular relationships shown are preserved. Hypoid gears provide quiet operation, although if these bevel gears are of molded plastic they will be quiet. Spur gears, although not normally suited for angular engagements, are simple to design. A worm gear would engage drive shaft 60 with the drive shaft tangentially connected to the pinion shaft rather than radially as shown. Therefore the term "bevel gear" is used generically where mentioned in the present disclosure to include all gears that may function in this capacity.

Drive shaft 60 transfers motion from pinion shaft 50 to worm gear shaft 70 (FIG. 15). With respect to drive shaft 60, gear 55 is a drive gear, and gear 72 is a driven gear. Drive shaft 60 may be molded or formed as a single piece incorporating both of gears 61 and 62. In FIG. 7 shaft 60 is angled slightly. This is because bevel gear 61 is off-center to fit above bevel gear 55 while remaining as large as possible as described above. Bevel gear 62 at the front of drive shaft 60 spans the full thickness of the housing so that is can be as large as possible and also be centered to worm gear shaft 70, shaft 70 including stem 78 shown in FIG. 7. Drive shaft 60 is held by bearings integrated into body 20. Channel 24 (FIGS. 5, 6) provides most of the support. From the facing side in FIGS. 5, 6 (top in FIG. 7) the shaft is held by bearings 24*a* and 24*b*. The feature in FIG. 7 under shaft 60 at bearing 24*a*, is a slot in body 20 to facilitate molding of the cross member that comprises bearing 24*a*. Drive shaft 60 includes stem 64 that rides in bearing 24*b*. Since stem 64 and bearing 24*b* are adjacent to bevel gear 55, gear 61 is held an accurate distance from bevel gear 55.

Drive shaft bevel gear 62 engages bevel gear 72 of worm gear shaft 70. About 6 turns are required in a preferred embodiment to provide full travel of jaw 80. Further speed increase could be achieved by making driven gear 72 smaller than drive gear 62. However as discussed above a smaller gear will provide a weaker link. Instead of any gears being made smaller than necessary, bevel gear 55 is greatly enlarged into an available space.

Worm gear shaft 70 includes stem 78, the upper portion of which is supported in bracket 90 (FIGS. 1, 13). This upper portion may be formed as a groove in shaft 70. Worm shaft 70 includes intermediate diameter shanks 73*a* and 73*b*. Shank 73*b* may form a core for helical worm gear 74 as shown. Shank 73*b* provides a stop at shoulder 77 against which presses bracket 90. Tabs 98 of bracket 90 fit into slots 18 (FIG. 4) of housing 10. Force upon jaw 80 travels to jaw teeth 84, to worm gear 74, which in turn presses bracket 90 by shoulder 77, which through tabs 98, presses housing 10. Thus jaw 80 is linked to housing 10. Optionally indentations 18*a* (FIGS. 4, 7) may be provided to better support tabs 98 and thus support worm gear shaft 70 nearer to its center axis. This can reduce flexing of bracket 90 under load. Indentations 18*a* may in fact function without slots 18, where bracket 90 rests upon edges formed atop indentations 18*a*. Body 20 does not experience these forces which is especially important if body 20 is made of plastic or die cast. Rather body 10 provides lower force positioning and guiding of the drive system. Optionally the bottom part of worm gear 74 may comprise a shoulder 77 and directly press bracket 90, if a distinct shank 73*b* is not present. Lower shank 73*a* provides a stop to support jaw 80 against upward forces. Stem 78 fits within notch 97 of bracket 90. Worm gear shaft 70 turns in bearings 25*a* and 25*b* of body 20 at upper guide 75*b* and lower guides 75*a*. Other coaxial diameters of worm gear shaft 70 may be used as bearing guides. For example stem 78 in notch 97 provides some positioning of shaft 70, especially to hold shaft 70 within the slot of guide 75*b*. Bracket 90 includes tab 92 to fit slot 29 of body 20. This helps hold bracket 90 for assembly and provides register of body 20 relative to bracket 90. A rivet directly above guide 75*b*, in respective holes 13 and 21 at this location, may hold worm gear shaft against upward forces. This function may be in addition to or instead of the support from shank 73*a*.

Spring 110 (FIG. 1) presses shoulder 76 of worm shaft 70. In the illustrated embodiment this spring is a wire segment. This provides a light friction to prevent over-speeding of worm shaft 70. It has been found that the mechanism of the present invention is so efficient that over-spinning of worm gear shaft 70 can cause jaw 80 to become locked against a fastener or fixed jaw face 12. A gentle friction at shaft 70 provides a pleasant feel to the action of switch 100 and prevents over spinning. Such friction further helps to hold jaw 80 in position for repeated use at a selected opening size. As shown in FIG. 1 a small gap 78 is present between the bottom of worm gear shaft 70 and the bottom of guide 25*a*. Shaft 70 is preloaded in an up position by spring 110 pressing shoulder 76. If, despite of the gentle friction from spring 110, jaw 80 is moving too fast as it clamps an object the worm gear shaft will move down slightly into gap 78 until shoulder 77 presses bracket 90. This motion absorbs some of the clamping energy to reduce the possibility of locking jaw 80. The motion associated with gap 78 should be minimal, so that the jaw action does not feel mushy since this motion must be overcome before jaw 80 locks tightly on a fastener. Using enough friction from spring 110 against shaft 70 reduces the need for the motion related to gap 78.

Figure 3:
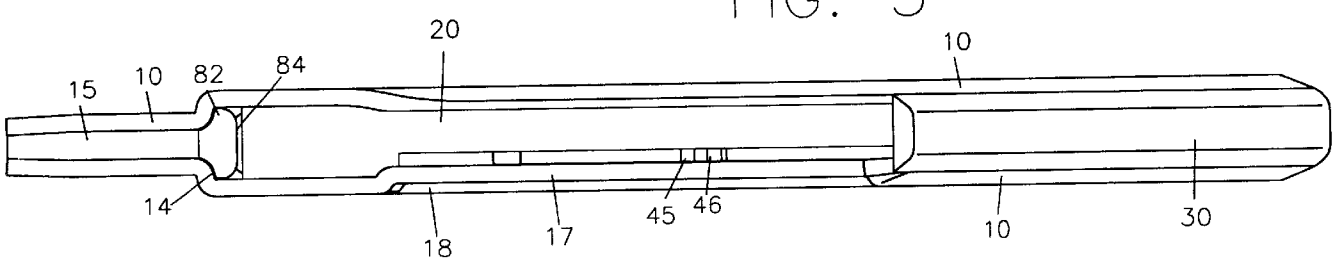
FIG. 3 is a top view of the wrench of FIG. 1 or 2, with the switch removed.

Jaw 80 includes flange 82 (FIG. 3). Housing 10 includes step 14 creating an elongated crease including a rearward facing edge that faces flange 82. Step 14 defines two levels for the surface of housing 10. Step 14 preferably includes at least a sharp inside bend so that flange 82 has a secure surface to press against. Step 14, flange 82 and interface 87 together provide a guide track for jaw 80 to move toward and away from fixed jaw face 12. Step 14 forms a sturdy feature to rigidly link jaw 80 to housing 10 and comprises a low cost method to form a guide track into a sheet steel formed laminated housing. Optionally only one plate of housing 10 may include step 14. Flat 16, FIGS. 1 and 2, in front of step 14 provides a narrowed space to support jaw 80 from wobbling in and out of the page in FIG. 1. See also FIG. 7. Optionally flat 16 may be near the same level as the majority of housing 10, with step 14 being a creased rib.

The present invention comprises a sturdy laminated steel construction with a low cost multifunction body core as body 10. Various methods may be used to fabricate the elements of the wrench of the invention. The housing is of two primary sheet steel pieces, preferably including contours to improve comfort and utility. The body within the housing functions as a spacer to hold the steel pieces in a fixed relationship creating a strong shell structure. Importantly the body includes additional functions to create cavities, guides and other structures to accommodate the moving parts of the mechanism. Other types of mechanism could be fitted into the body according to the invention. For example a belt or helical drive shaft and associated components, as described in the prior art slide adjustable wrenches, could efficiently be contained and supported within a body according to the present invention. In this instance a slide switch links to a movable jaw through a belt, chain, or helix shaft, where the respective components are supported and guided by a molded or similarly formed body, with the body further serving to position a sheet steel formed housing that substantially surrounds the body. For example in FIG. 1 drive shaft 60 could be helically cut and switch 100 linked to it by known methods. Of course suitable helix angles and gear ratios are required for reasonable strengths, friction and switch travel distances. As discussed in the Background section such suitable conditions can be difficult to achieve economically with prior art belt and helix designs. The gears used in the present invention are easy to assemble since they consolidate multiple gears into single piece parts which in turn are solid shapes that are easy to assemble.

A contoured shape of the wrench includes a continuous exterior surface with no exposed metal edges. The multifunctioned body provides recesses in each face into which the plates of the steel housing are placed. The recesses may be surrounded by a rubber edge strip that is molded onto edges of the body to provide a substantially seamless connection between the rubber and the steel surface. The laminated wrench design described herein may be useful in other types of wrenches and tools. For example a conventional worm gear only type forged adjustable wrench, or the laminated pliers of U.S. Pat. No. 4,802,390 could be improved using the flanged edges, recessed body and/or the multifunctioned body of the present invention. Ratchet wrenches are another example of a tool which is suitable for use with the present laminated design, with the rotating end comprising an engaging end.

It is possible to form the body of the wrench as a solid metal construction. A suitable cavity is provided to fit a member analogous to body 20. This member supports and guides the various gears and drive elements, but may not form a structural element of the tool housing.

From the foregoing detailed description, it will be evident that there are a number of changes, adaptations and modifications of the present invention which come within the province of those skilled in the art. However, it is intended that all such variations not departing from the spirit of the invention be considered as within the scope thereof as limited solely by the claims following.

What is claimed is:

1. An adjustable wrench including a movable jaw and an opposed fixed jaw, the movable jaw driven toward and away from the fixed jaw by means of a rotatable worm gear that engages teeth of the movable jaw, a switch slidable along a length of the wrench, the switch linked to a drive system so that movement of the switch causes rotation of the worm gear, the drive system including:

an elongated gear rack which moves along the length of the wrench in a direct relationship with the movement of the switch;

a pinion gear engaging the gear rack, the pinion gear rotating as the gear rack moves, the pinion gear coaxially connected to a first bevel gear to form a pinion shaft, wherein the first bevel gear rotates as part of the pinion shaft;

a drive shaft linking the pinion shaft to a worm gear shaft, the drive shaft including a second bevel gear at a drive shaft rear end engaging the first bevel gear, the drive shaft further including a third bevel gear at a drive shaft front end, the drive shaft rotating as the pinion shaft rotates;

the third bevel gear engaging a fourth bevel gear, the fourth bevel gear being coaxially affixed to the worm gear, the worm gear shaft including the worm gear and the fourth bevel gear, the worm gear shaft rotating as the drive shaft rotates;

the movable jaw moving in relation to the fixed jaw as the worm gear shaft rotates, and the movable jaw moving in relation to the fixed jaw as the switch is moved along the length of the wrench.

2. The adjustable wrench of claim 1 wherein the first bevel gear is larger in diameter than the pinion gear.

3. The adjustable wrench of claim 1 wherein the wrench includes a head, a handle, a top, a bottom, first and second sides, and a thickness, the pinion shaft rotates about an axis that extends across the thickness of the wrench, the first bevel gear laying adjacent to an interior of the first side, the pinion shaft extending to the second side.

4. The adjustable wrench of claim 3 comprising a laminated construction wherein metal plates form respective facings on the first and second sides, a body forms a spacer between the metal plates, the gear rack slides within a rack channel of the body.

5. The adjustable wrench of claim 3 comprising a laminated construction wherein metal plates form respective facings on the first and second sides, a body forms a spacer between the metal plates, the drive shaft rotates within a drive shaft channel of the body, the drive shaft channel being at least partially open to one side of the body.

6. The adjustable wrench of claim 5 wherein cross members of the body pass over the drive shaft channel, and the cross members retain the drive shaft within the channel.

7. The adjustable wrench of claims 4 or 5 wherein the body comprises a molded plastic material.

8. The adjustable wrench of claims 4 or 5 wherein the body comprises a die cast metal.

9. The adjustable wrench of claims 4 or 5 wherein the body comprises pressed and sintered powdered metal.

10. The adjustable wrench of claim 3 wherein the switch is exposed on a top of the handle, whereby the switch is operable from the top of the wrench.

11. The adjustable wrench of claim 10 wherein the switch is connected to the gear rack through a slot along the top of the handle.

12. The adjustable wrench of claim 10 wherein the switch includes a portion extending down one side of the handle from the top of the handle.

13. The adjustable wrench of claim 10 wherein the switch is pivotably connected to the gear rack, and the switch follows an arcuate contour on the top of the wrench whereby the switch pivots in relation to the gear rack as the switch moves along the length of the wrench.

14. The adjustable wrench of claim 1 comprising a laminated construction wherein metal plates form respective facings on first and second sides of the wrench, the plates include opposed openings in the two sides, a bracket at least partially surrounds the worm gear shaft, the bracket supporting the worm gear, the bracket including tabs engaging the opposed openings so that through a linkage formed by the bracket, the worm gear is supported by the metal plates.

15. The adjustable wrench of claim 1 wherein a spring presses the worm gear shaft, the spring creating resistance to rotation of the worm gear shaft.

16. The adjustable wrench of claim 15 wherein the spring presses the worm gear along an axis of rotation of the worm gear shaft, in a direction to bias the movable jaw toward the fixed jaw.

17. The adjustable wrench of claim 14 wherein the metal plates each is bent into a step creating an elongated crease, the crease extending in a direction coincident with the direction of motion of the movable jaw, the crease comprising part of a guide track for the movable jaw.

18. An adjustable wrench including a movable jaw and an opposed fixed jaw, the movable jaw driven toward and away from the fixed jaw by means of a rotatable worm gear that engages teeth of the movable jaw, a switch slidable along a length of the wrench, the switch linked to a drive system so that movement of the switch causes rotation of the worm gear, the drive system including:

an elongated gear rack which moves along the length of the wrench in a direct relationship with the movement of the switch;

a pinion gear engaging the gear rack, the pinion gear rotating as the gear rack moves, the pinion gear comprising an element of a pinion shaft;

a drive shaft linking the pinion shaft to a worm gear shaft, the drive shaft rotating about an axis substantially perpendicular to a rotation axis of the pinion shaft;

the worm gear shaft rotating about an axis substantially perpendicular to both the rotation axis of the drive shaft and the rotation axis of the pinion shaft;

the movable jaw moving in relation to the fixed jaw as the worm gear shaft rotates and the movable jaw moving in relation to the fixed jaw as the switch is moved along the length of the wrench.

19. The adjustable wrench of claim 18 wherein the rotation axis of the drive shaft intersects the rotation axis of the pinion shaft.

20. The adjustable wrench of claim 18 wherein the rotation axis of the worm gear shaft intersects the rotation axis of the drive shaft.

* * * * *